US006883734B1

(12) United States Patent
Horii et al.

(10) Patent No.: US 6,883,734 B1
(45) Date of Patent: Apr. 26, 2005

(54) METHOD AND DEVICE FOR STABILIZING SLIT FLUID JET

(75) Inventors: Kiyoshi Horii, Tokyo (JP); Akitake Hashitate, Kanagawa (JP)

(73) Assignee: Mayekawa Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/031,597

(22) PCT Filed: Apr. 27, 2000

(86) PCT No.: PCT/JP00/02776

§ 371 (c)(1),
(2), (4) Date: May 23, 2002

(87) PCT Pub. No.: WO01/84059

PCT Pub. Date: Nov. 8, 2001

(51) Int. Cl.[7] ..... B05B 1/00; B05B 1/04; B05B 1/14; F23D 14/68

(52) U.S. Cl. ..... 239/590; 239/590.5; 239/592; 239/598

(58) Field of Search ..... 239/589.1, 590, 239/590.3, 590.5, 591, 592, 398, 424.5, 419, 239/419.3, 419.5, 433, 427, 596, 597, 598

(56) References Cited

U.S. PATENT DOCUMENTS 4,662,568 A * 5/1987 Bauer ..... 239/589.1
5,547,094 A * 8/1996 Bartels et al. ..... 216/33
6,127,571 A * 10/2000 Mulvaney, III ..... 562/98

FOREIGN PATENT DOCUMENTS

JP 54-17650 2/1979
JP 2-116794 5/1990

* cited by examiner

*Primary Examiner*—Nicholas D. Lucchesi
*Assistant Examiner*—Matthew F DeSanto
(74) *Attorney, Agent, or Firm*—Wenderoth, Lind & Ponack, L.L.P.

(57) ABSTRACT

A fluid film is formed stably over a long distance from a nozzle without breaking a slit fluid jet by allowing fluid flow out from a slit to form a slit fluid jet. A crossed flow is superimposed causing a flip-flop phenomenon upon the slit fluid jet. Energy of a fluctuation velocity component of the slit fluid jet is absorbed into a vibration component of a flip-flop crossed flow so as to form a stable fluid film.

2 Claims, 4 Drawing Sheets

METHOD AND DEVICE FOR STABILIZING SLIT FLUID JET

TECHNICAL FIELD

The invention relates to a method of stabilizing a slit fluid jet and a device therefor. More particularly, the invention concerns a method of stabilizing a slit fluid jet and a device therefor which are useful, especially for preventing fluid and solid from entering into a space of control from outside, or for preventing fluid and solid from escaping from the space of control to the outside.

BACKGROUND ART

In a prescribed space of control of a building structure, a mechanical apparatus, etc., a slit fluid jet has hitherto been used as means for preventing fluid and solid from entering into the space of control from outside, or for preventing fluid and solid from escaping from the space of control to the outside.

For example, in a general type of building structure, an air curtain that is a kind of slit fluid jet is ejected at each of the inlet and outlet thereof to thereby make effective the zoning between the space of control and the external air, thereby the air-conditioning efficiency is successfully enhanced.

Also, in a processing apparatus for frozen food, air curtains are ejected from the surroundings of a processing part thereof, to thereby form a space of cool air for the low-temperature preservation of foodstuff.

Further, in a machine tool, liquid curtains or shower curtains are ejected from the surroundings of a machining part thereof, to thereby prevent cut shavings from being scattered, or splashing out, from the space of machining. This slit fluid jet such as the air curtain, liquid curtain, or shower curtain is formed by ejecting fluid from an apparatus using a pair of smooth flat surfaces or curved surfaces or an apparatus wherein nozzles are arrayed.

However, although the above-described slit fluid jet has greatly contributed to forming the space of control, it has a lot of problems from the viewpoint of efficiently forming a large space of control.

Namely, to form a large space of control through the use of such a slit fluid jet, it is necessary to increase the velocity of that slit fluid jet. However, generally, increasing the velocity of the fluid results in the instability of the film of the fluid increasing. This raises the problem that the filmy fluid of the slit fluid jet is likely to be broken.

This likeliness to break of the fluid film of the slit fluid jet is attributable to the turbulence component (variable speed component) of the fluid. This turbulence component causes the exfoliation of the shearing layer on the inner wall of the slit, the creation of the exfoliation vortexes, the entrapment of air at the outlet of the slit, etc. It thereby makes the thickness of the fluid film of the slit fluid jet uneven, with the result that the fluid film becomes broken due even to a small intensity of disturbance.

On this account, as one of the countermeasures against this, it is thought to be possible to decrease the velocity of the slit fluid jet to thereby stabilize the film of the fluid. However, making the velocity of the fluid low results in that the fluid film is broken even by a small intensity of disturbance.

Also, further, the above-described likeliness of breaking the fluid film becomes serious as the distance as measured from the slit opening increases. Namely, as the distance from the slit opening increases, the thickness of the slit fluid jet becomes very small, so that it is easily broken due even to a very small magnitude of disturbance.

In order to take measures to address the problem of the above-described likeliness to break the fluid film, usually, in general, the fluid film of the slit fluid jet is made thick. However, this means increasing the flow rate of the slit fluid jet, but this becomes a factor causing a rise in the running cost.

Whereupon, this invention has been made in view of the shortcomings of the conventional techniques mentioned above, and an object of the present invention is to provide a method of stabilizing a slit fluid jet and a device therefor which enable a stable fluid film to be formed from an ejection opening of the slit over a long distance with the slit fluid jet not being broken.

SUMMARY OF THE INVENTION

The invention, as means for solving the above-described problems, first, provides a method of stabilizing a slit fluid jet, comprising superimposing a fluid jet accompanied with a flip-flop phenomenon upon one, or both, of the surfaces of a slit fluid jet and thereby forming a stable slit fluid jet.

Further, the invention, secondly, provides a stabilizing device for stabilizing a slit fluid jet, the stabilizing device being adapted to stabilize the slit fluid jet. The stabilizing device is equipped with two flat plates that oppose each other with a prescribed gap in between. One of the flat plates of the slit having an opposing surface that is smooth, and the other having a network structure that has a plurality of crossed grooves that are crossed like a letter x. The invention, thirdly, provides a stabilizing device for stabilizing the slit fluid jet, wherein at an outlet of the fluid there are disposed flow passages of the network structure so that the fluids may be merged. The invention, fourthly, provides a stabilizing device for stabilizing the slit fluid jet, wherein a length between an detouched vortex, occurring at a back of the crossed groove portion, and a point to where the detouched vortex has been shifted is equal to or greater than the length of one side of a diamond-shaped protruding portion that is formed by the x-shaped grooves.

DETAILED DESCRIPTION OF THE INVENTION

Figure 1:
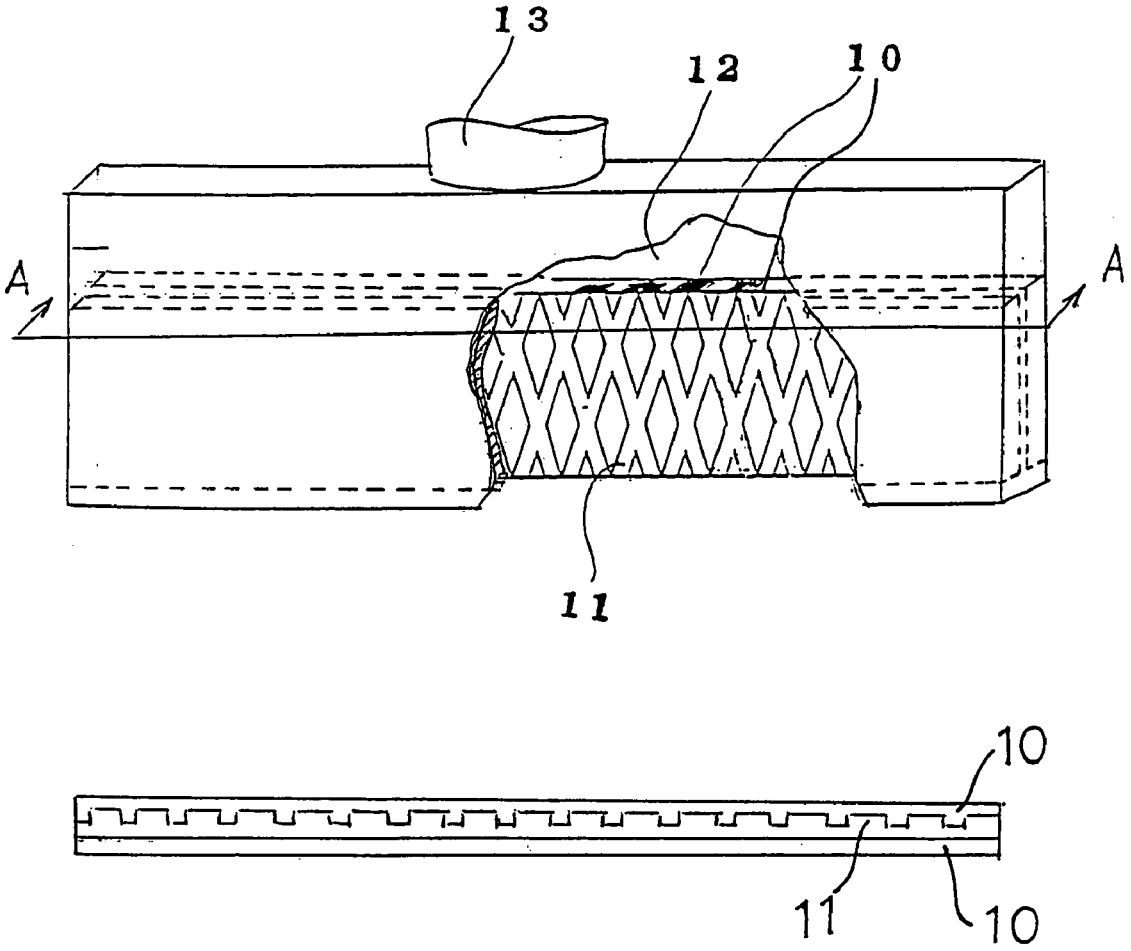
FIG. 1 is a schematic diagram illustrating the present invention.

It is to be noted that the symbols in the figures represent the following: flat plate 10, crossed groove 11, buffer region 12, fluid supply pipe 13, air bubbles 14, and vortex 15.

Generally speaking, instability of a fluid film is attributable to turbulence of the flow, i.e., the variable speed component. A fluid necessarily contains this variable speed component. Therefore, extreme difficulties are encountered in eliminating that turbulence.

On that account, the present invention performs hydrodynamic control with respect to the conventional simple slit fluid jet. More specifically, the invention, in order to make uniform the non-uniformity of the fluid film thickness that results from the turbulence of the fluid, has formed a fluid film that has a two-layer structure of a slit fluid jet flow and a flip-flop flow. The invention of this application has resultantly added a mechanism for absorbing, with the lapse of time, the variable speed component that is contained in the slit fluid jet flow. In this respect, the invention of this application has a great characterizing feature.

In the process of reaching the present invention, the inventors had initially thought that, if a phenomenon peculiar to a fluid that occurs utilizing the variable speed in the fluid as the energy of it is superimposed upon the slit fluid jet flow, a stable fluid film will be formed. Based on this idea, the inventors have conceived the fact that a detouched vortex, which appears in the flow at the back of a substance and which is typically represented by a von Karman vortex, periodically occurs due to the existence of the variable speed component.

Namely, when a substance has flow passages that have been disposed in a zigzag way, at each of the crossed portions thereof there occurs a flip-flop phenomenon in which periodic vibrations occur in the radial direction of the flow. This flip-flop phenomenon is the mechanism for absorbing the variable speed component with the lapse of time, and the flip-flop phenomenon is known as converting that variable speed component to the periodic vibrations that occur in the radial direction of the main flow.

The inventors have applied the flip-flop phenomenon to actual stabilizing of the slit fluid jet flow, and have thereby come to the present invention.

Regarding the method of stabilizing the slit fluid jet flow according to the present invention, more specifically, if causing a fluid to be ejected from the slit opening to thereby form a slit fluid jet, superimposing a crossed flow, which is followed by the flip-flop phenomenon, upon this slit flow jet, and thereby causing the variable speed component energy of the slit fluid jet to be absorbed into the vibration component of the flip-flop crossed flow, a stable fluid film is formed. The flip-flop crossed flow is formed by means of a network terminal formed by a plurality of crossed grooves and causes the jet flow to periodically vibrate in the radial direction of the grooves. This periodic vibration is caused by the flow of the fluid and the periodic vibration is amplified by the interaction between the ejected pieces of flow. This groove flow structure that is constructed of a plurality of groove flows acts to convert the turbulent component of the fluid into the periodic vibration component that is active in the radial direction of the grooves.

Namely, the network structure that is comprised of the flow passages formed by the grooves controls the turbulent component of the fluid, causes the flip-flop phenomenon to occur at each of the points of merging of the groove flows, and causes each of the groove flows to periodically vibrate in the radial direction of the groove.

The slit fluid jet upon which this flip-flop crossed flow is superimposed becomes stabilized. This is because, if the jet flow followed by the flip-flop phenomenon exists on any one surface of the liquid film of the slit fluid jet, the component of fluctuation of the slit fluid jet is converted into the flip-flop phenomenon energy that is active upon that jet.

A device for stabilizing the slit fluid jet according to the present invention includes, as an aspect, the one that has been illustrated in FIG. 1.

This stabilizing device for the slit fluid jet having surfaces is constructed of two flat plates (10) that oppose each other with a prescribed spacing in between. An inside of one of the flat plates (10) is smooth while the other thereof has a network structure that has a plurality of crossed grooves (11), the configuration of which is shaped like a letter x.

Preferably, the flow passages of the network structure are located so that the pieces of fluid may merge in the flow-out opening of the fluid, and it is also preferable that the distance from an detouched vortex appearing at the back of each of the crossed portions to the point to which that detouched vortex has been shifted be equal to or greater than one side of the diamond-shaped protruding portion formed by the x-shaped grooves.

Incidentally, although it is preferable that the flat plates (10, 10) be flat surface members, they may be curved surface members. In that case, that a clearance that is a gap between the opposing members be equal, preferably, is made a requirement.

Also, a buffer region (12) for the fluid may be formed at one side of the clearance. The fluid that has been supplied from a fluid supply pipe (13) is allowed to flow between the paired opposing members, and this fluid is ejected as a slit fluid jet.

Figure 2:
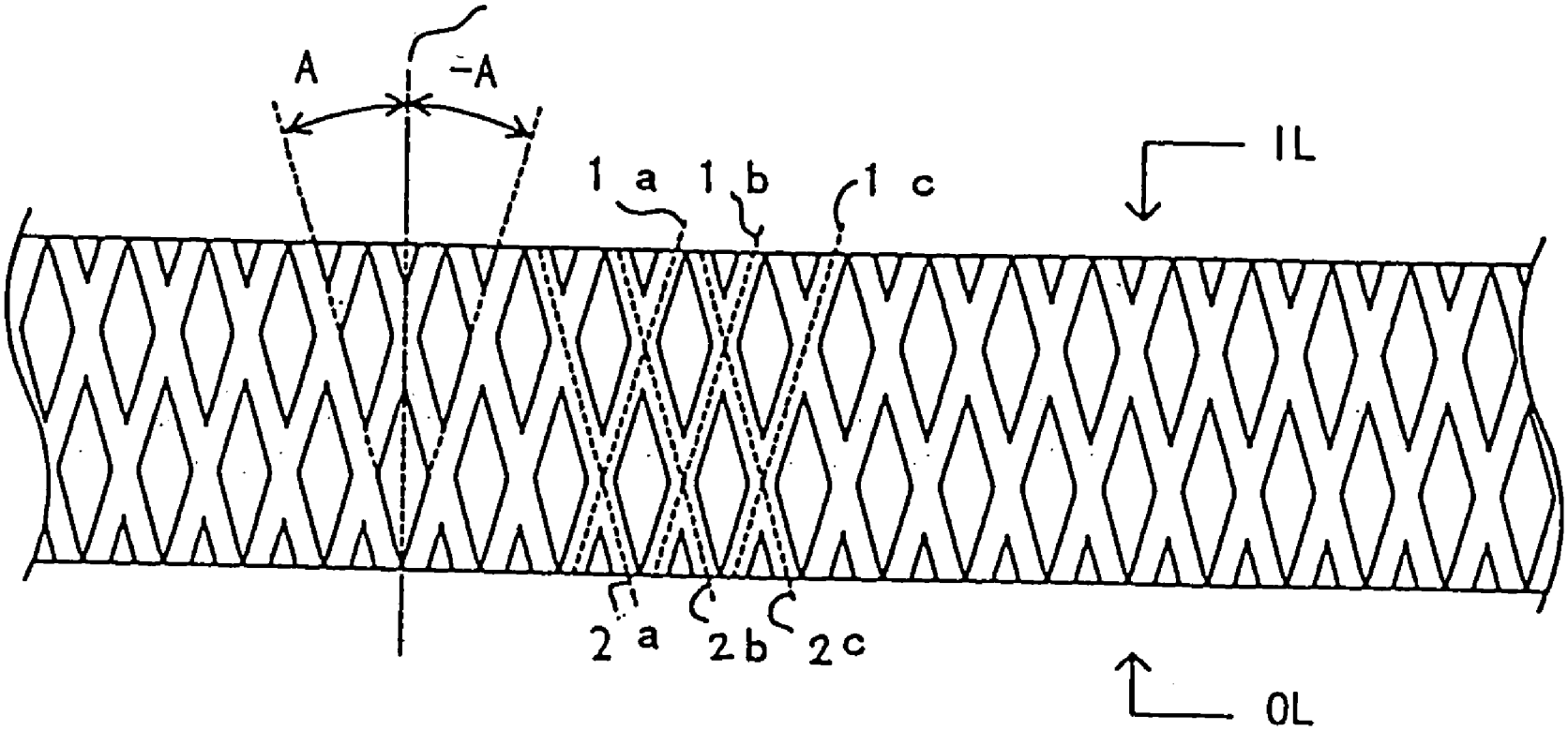
FIG. 2 is a plan view illustrating a flow structure of the present invention.

FIG. 2 is a view illustrating, as a plan view, a member inside the slit that has a network structure. This member has provided therein as the passages of fluid a plurality of grooves 1*a, b, c, . . . , n* and a plurality of grooves 2*a, b, c, . . . , n* in a way in which both form net meshes. The respective ones of the grooves 1*a, b, c, . . . , n* are provided at equal intervals and in parallel with one another, and the respective ones of the grooves 2*a, b, c, . . . , n* are also provided in the same way.

A plurality of grooves that are included in the angular region (A) defined between the flow and the main axis and a plurality of grooves that are included in the angular region (−A) that has been similarly defined are provided each in paired relationship with each other so that the pieces of fluid may merge together to go out from the ejection opening. Namely, they are provided so that the fluid that has been supplied from an inlet portion (IL) of the fluid may merge together at an outlet portion (OL). As a result of this, the pieces of fluid make out, at the merging portion, the fluid jet having the periodic vibration component that is active in the right and left directions of the drawing sheet.

Figure 3:
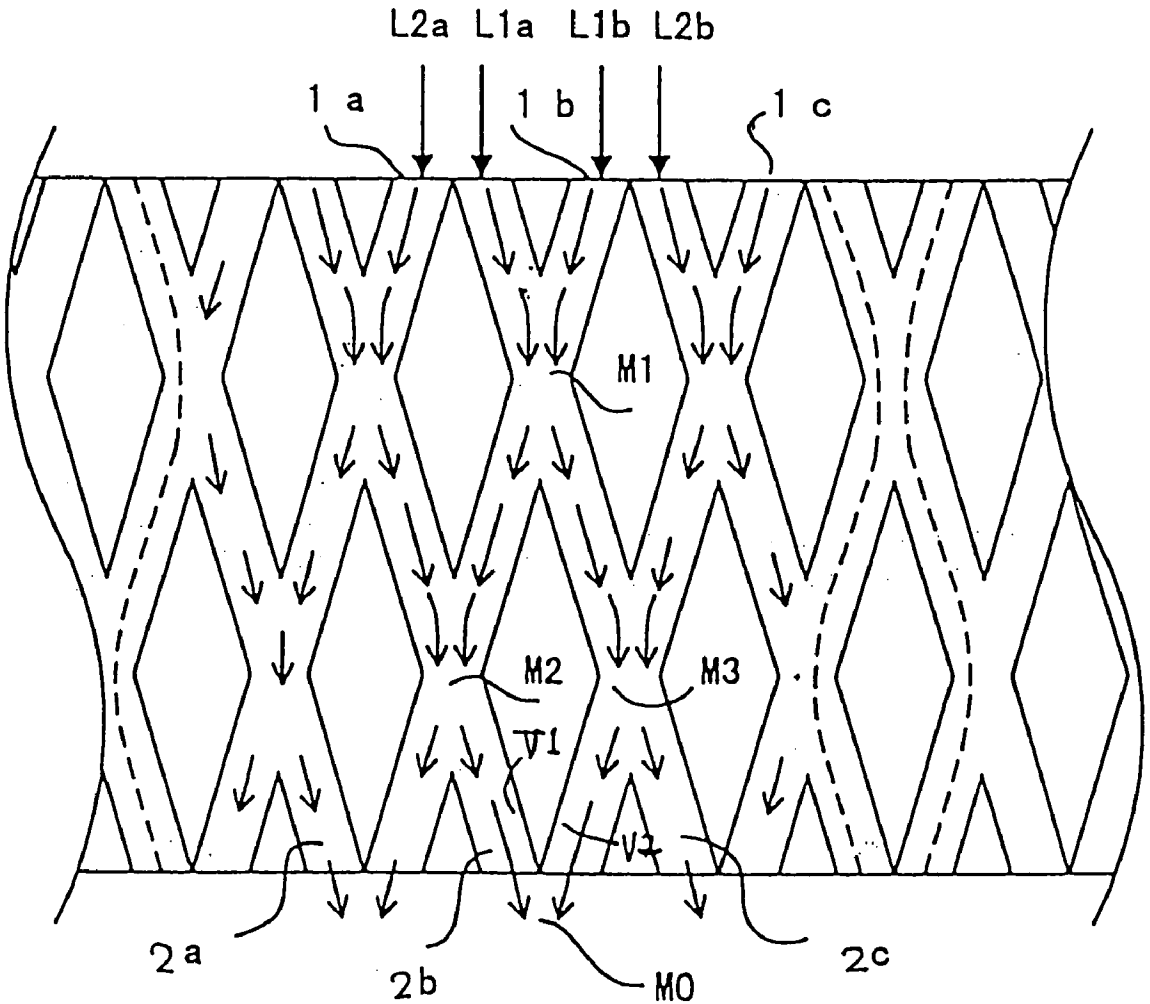
FIG. 3 is a plan view illustrating a flow structure of the present invention.

In FIG. 3, since the fluid is being supplied under a prescribed pressure from the buffer region (12), the fluid flows into the groove 2*c* as a fluid jet L1*a* and the fluid flows into the groove 1*b* as a fluid jet L1*b*. The two pieces of liquid flow merge at a crossed passage M1. As a result of this merging, the flow speed is accelerated, whereby at this crossed portion there is a point of energy supply where the flow speed is maximized and the pressure is minimized. At the back of that crossed portion, there are formed asymmetrical detouched vortexes. These asymmetrical detouched vortexes at the back of that crossed portion are affected by the point of energy supply and, with the lapse of time, their position and shape are changed, whereby those asymmetric detouched vortexes alternately appear at the positions of V1 and V2 (see FIG. 4 as well). The period in which they alternately appear depends upon a Strouhal number that is almost in inverse proportion to a Reynolds number.

A further explanation will now be given of the details of the flip-flop phenomenon that is the important basic principle of the present invention.

This flip-flop phenomenon is based on the utilization of the fact that the speed fluctuation at the back flow of a substance has periodicity. For example, when there is a substance in the course of flow whose speed is V, the vortexes that mutually rotate in opposite directions alternately occur from that substance and flow backward. For this reason, periodicity occurs in the fluctuation of speed in the back flow of the substance. The frequency at which those vortexes occur is given by the dimensionless Strouhal number St= f L/V, where the f represents the frequency in the periodic fluctuation phenomenon of the fluid; L represents the projection length of the substance toward the surface vertical to the flow (in general, the significant length of the substance configuration, and if that substance is a circular columnar member, the diameter of it); and V represents the speed of the fluid. For example, that an electric wire sounds cracked on a day with strong wind is the phenomenon that that vortex is released.

In general, the Strouhal number depends upon the configuration of the substance. In the case of, for example, a circular columnar member, it is known that when the Reynolds number is from 1,000 to 100,000, the Strouhal number is 0.2.

In the natural world, there is a living being that well utilizes the fact that periodicity exists in the vortexes at the back flow of a substance. Lighthill describes in his "Mathemetical Biofluid mechanics, Society for Industrial and Applied Mathematics, 1975" as follows. A group of fish that takes a network structure of x-shaped meshes, which while being situated at a diagonal position are swimming at the back of other fish, tends to decrease the resistance applied to that group of forwardly moving fish through the use of the periodic vortex flows that are released from the fish that is ahead.

Especially, the positional relationship in the network structure of x-shaped meshes acts to make the vortexes maintain their periodicity, while making the energy thereof kept increased. Accordingly, it is thought that the network structure of x-shaped meshes, which is formed by a plurality of crossed grooves, will be useful, from the viewpoint of such a natural phenomenon as well.

Figure 4:
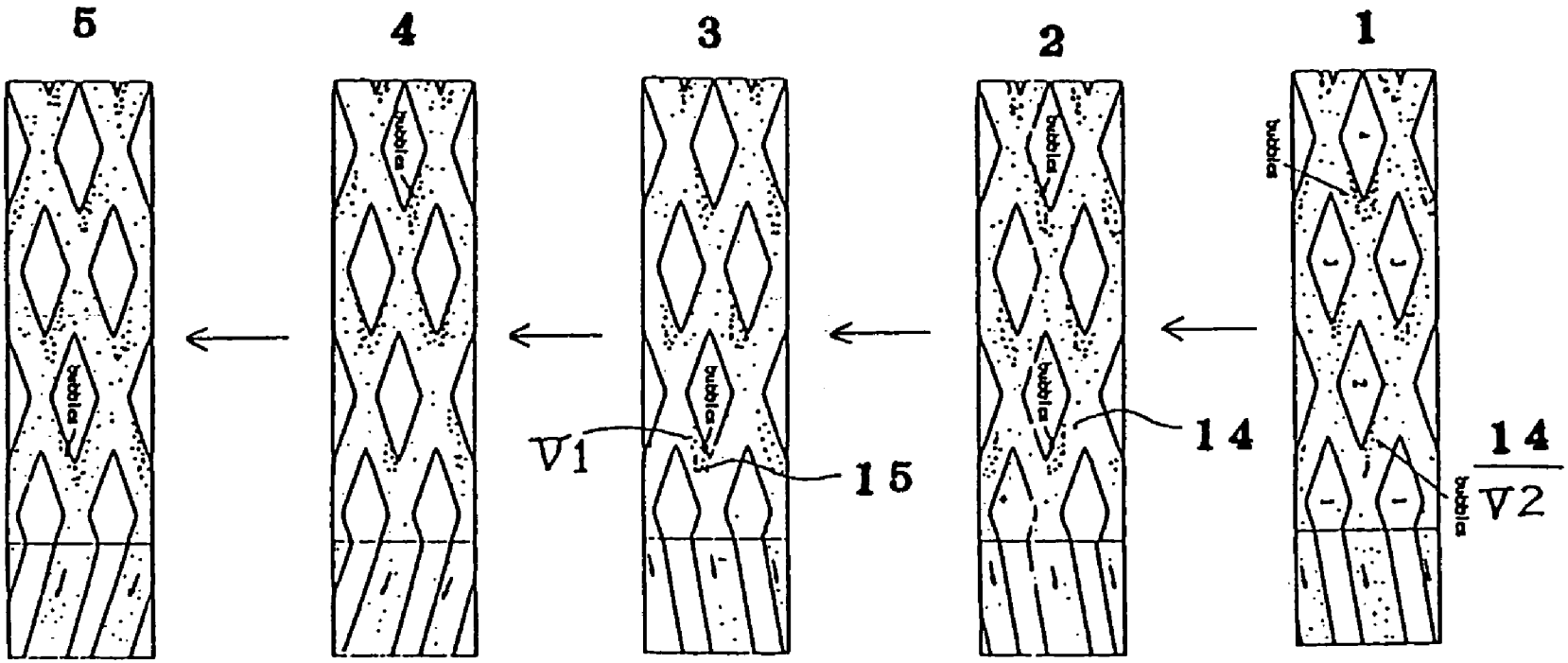
FIG. 4 is a schematic diagram illustrating a flip-flop phenomenon that is a basic conception of the present invention.

Next, using FIG. 4, an explanation will be given of the flip-flop phenomenon that occurs in the flow in the network structure of x-shaped meshes. In Step 1, there is illustrated a state where an air bubble (14) begins to occur at a right/upper position of the network structure of x-shaped meshes. Step 2 illustrates a state where 0.3 second has lapsed from Step 1. In this state, that air bubble becomes large and resultantly a vortex enlarges. Step 3 illustrates a state where 0.3 second has further lapsed from Step 2. In this state, that vortex exfoliates and flows away to the back side. Simultaneously with this, it has been observed that a vortex (15) occurs at a right/lower position of the network structure of x-shaped meshes. In Step 4, this vortex (15) enlarges and in Step 5 the vortex (15) exfoliates.

In that way, the exfoliation of a vortex periodically occurs to thereby cause the occurrence of the flip-flop phenomenon that vertically vibrates the jet flow at the backward opening of ejection.

Also, in the flows in the interiors of the network grooves that are formed by a plurality of the crossed grooves, not only the periodic vibration phenomena of the jet flow that occurs at the network terminal, but also the interaction between the pieces of ejection of the fluid occur in various ways. That interaction includes, for example, the appearance of the Lamb effect (the ultrasonic vibrations appearing on the surface of a small-thickness solid), the vibration phenomenon of a shear layer caused to appear due to the conflict between the pieces of flow, the attraction characteristic appearing due to the detouched vortexes, and the Coanda effect.

Hereinafter, an embodiment of the present invention will be discussed below and the invention will be explained in more detail.

EXAMPLE

Using the stabilizing device for a slit fluid jet according to the present invention, a slit fluid jet was actually formed and its behavior was observed.

In this device, the width was 1,000 mm, the angle of the grooves was 15 degrees, the width of the grooves was 2 mm, the depth thereof was 1 mm, and the clearance between the network structure of x-shaped meshes and the surface having no such network structure was 0.5 mm.

When water was jetted from the slit at a flow speed of 0.5 m/s, a stable film of water with no broken portion existing therein was formed over a length of 1000 mm. In addition, the thickness of the water film on an upstream side thereof was substantially the same as that of the thickness on a downstream side thereof. The amount of flow of water at that time was 30 liter/min.

On the other hand, regarding an ordinary slit fluid jet having surfaces and having no network structure, experiments were conducted with the flow rate being the same. As a result, breakage occurred at a position in the vicinity of 20 mm and, at the same time, the thickness of the water film became extremely large toward the downstream side. In order to make the stable liquid film extend up to a position 1000 mm downstream when the liquid film was prepared from the ordinary slit fluid jet, an amount of flow of water of 200 liter/min. was needed.

Using air, the same experiment as in the case of water was conducted at the flow speed of 5 m/s. The resulting air jet was visualized using an argon laser sheet. In the case of the ordinary slit fluid jet, a breakage phenomenon occurred at a position 15 mm downstream of the film, whereas, in the case of the slit fluid jet flow ejected from the present invention, a stable air film was formed up to a position 650 mm downstream of the film.

INDUSTRIAL APPLICABILITY

As has been explained above in detail, according to the present invention, a stable fluid film is formed from the opening of ejection over a long distance with the slit fluid jet being not broken mid-course.

What is claimed is:

1. A stabilizing device for stabilizing a slit fluid jet having surfaces, said stabilizing device comprising:

a first flat plate, and a second flat plate, wherein said first flat plate and said second flat plate oppose each other with a prescribed gap in between, said first flat plate has an opposing surface that is smooth, and said second flat plate has a network structure with a plurality of crossed grooves that are crossed like a letter x.

2. A stabilizing device according to claim 1, wherein at an outlet of said network structure, said plurality of crossed grooves are disposed such that fluids passing therethrough are merged.

* * * * *